US006173450B1

(12) United States Patent
Hari

(10) Patent No.: US 6,173,450 B1
(45) Date of Patent: Jan. 16, 2001

(54) COSTUME AND TOY AND ASSOCIATED METHODS

(76) Inventor: Beverley A. Hari, 7669 Belvoir Dr., Orlando, FL (US) 32835

( * ) Notice: Under 35 U.S.C. 154(b), the term of this patent shall be extended for 0 days.

(21) Appl. No.: 09/459,847

(22) Filed: Dec. 13, 1999

(51) Int. Cl.[7] ..... A63H 33/00
(52) U.S. Cl. ..... 2/69; 446/28
(58) Field of Search ..... 2/69, 75, 80; D2/741; 446/28, 327

(56) References Cited

U.S. PATENT DOCUMENTS

| | | | | |
|---|---|---|---|---|
| 1,267,567 | * | 5/1918 | Lundgren | 446/24 |
| 2,705,803 | * | 4/1955 | Sheldrick et al. | 2/80 |
| 2,754,121 | * | 7/1956 | Jupiter | 272/57 |
| 3,382,504 | * | 5/1968 | Barbosa | 2/80 |
| 3,447,165 | * | 6/1969 | Brosk | 2/75 |
| 3,611,628 | * | 10/1971 | Noble et al. | 46/154 |
| 3,613,301 | * | 10/1971 | Noble et al. | 46/154 |
| 3,920,239 | * | 11/1975 | Whilte | 272/1 D |
| 4,138,745 | * | 2/1979 | Greenspan | 2/247 |
| 4,280,292 | * | 7/1981 | Hills | 40/538 |
| 4,300,307 | * | 11/1981 | Biasuzzi et al. | 46/154 |
| 4,498,199 | * | 2/1985 | Margolis | 2/69 |
| 4,722,098 | * | 2/1988 | Stapleton | 2/69 |
| 4,799,889 | * | 1/1989 | Yockey | 434/112 |
| 5,209,691 | * | 5/1993 | Ekstein | 446/28 |
| 5,359,731 | * | 11/1994 | Cavalier | 2/46 |
| 5,542,122 | * | 8/1996 | Molodovan | 2/69 |
| 5,643,037 | | 7/1997 | Altschul . | |
| 5,970,518 | | 10/1999 | Jordon . | |
| 6,006,365 | * | 12/1999 | Strandberg | 2/239 |

* cited by examiner

*Primary Examiner*—John J. Calvert
*Assistant Examiner*—Alissa L. Hoey
(74) *Attorney, Agent, or Firm*—Allen, Dyer, Doppelt, Milbrath & Gilchrist, P.A.

(57) ABSTRACT

The costume is representative of a character having a head, a body section, and at least two legs. The body section and the legs have a common interior space that is adapted to admit a wearer's lower body section and legs. A pair of false limbs is affixed to a rear of the costume so that they depend downward and forward toward a front of the costume when in use to provide an illusion that when donned the wearer is being carried by the costume character. The character's head is supported in an upright orientation against the wearer's chest with straps. The costume is also interconvertable between the costume configuration and a toy configuration wherein the interior space houses the legs and straps, and only the character itself remains visible.

22 Claims, 3 Drawing Sheets

COSTUME AND TOY AND ASSOCIATED METHODS

BACKGROUND OF THE INVENTION

1. Field of the Invention

The present invention relates to costumes and toys, and, more particularly, to costumes that create an illusion that the wearer is being carried by the costume character and to plush toys.

2. Description of Related Art

Costumes are known in the art that create illusions regarding the character that is the subject of the costume. For example, the costumes of Lundgren (U.S. Pat. No. 1,267,567) and of Stapleton (U.S. Pat. No. 4,722,098) make it appear as though the person wearing the costume is being carried by a character. However, it has been found that the heads and body parts of such costumes have a tendency to droop, rendering the costume less attractive and realistic.

SUMMARY OF THE INVENTION

It is therefore an object of the present invention to provide an improved costume that creates the illusion that the wearer is being carried by the costume character.

It is an additional object to provide a method of making such a costume.

It is a further object to provide a method of donning such a costume.

It is another object to provide a combined costume and plush toy.

It is yet an additional object to provide a method of making such a combined costume and plush toy.

It is yet a further object to provide a method of interconverting the figure between its costume and toy configurations.

These objects and others are attained by the present invention, which in one embodiment comprises a costume representative of a character. The character has a head, a body section, and at least two legs. The body section and the legs have a common interior space that is adapted to admit the lower body section and the legs of a wearer thereinto.

A pair of false limbs is affixed to a rear of the costume so that they depend downward and forward toward a front of the costume when in use. The limbs are preferably positioned to provide an illusion that when donned the wearer is being carried by the costume character.

A particular improvement of the costume comprises means for supporting the character's head in an upright orientation against the wearer's chest. Previous costumes known in the art had a particular difficulty with this feature, as the heads tended to droop downward, which spoiled the costume's appearance.

The costume further comprises means for being retained on the wearer. These retaining means are also adapted to improve the appearance of the costume in providing a realistic-looking illusion.

In another embodiment of the invention, an object is provided that permits interconversion between a costume configuration and a toy configuration. In this embodiment, the object comprises the costume as described above, with an addition that the interior space is further dimensioned to house the legs and the means for being retained. Thus, to convert the object to the toy configuration, the limbs and means for being retained are inserted into the interior space via the opening, and only the character itself remains visible.

The character can then be used as a toy, for example, as a stuffed animal if the character is of the plush variety.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
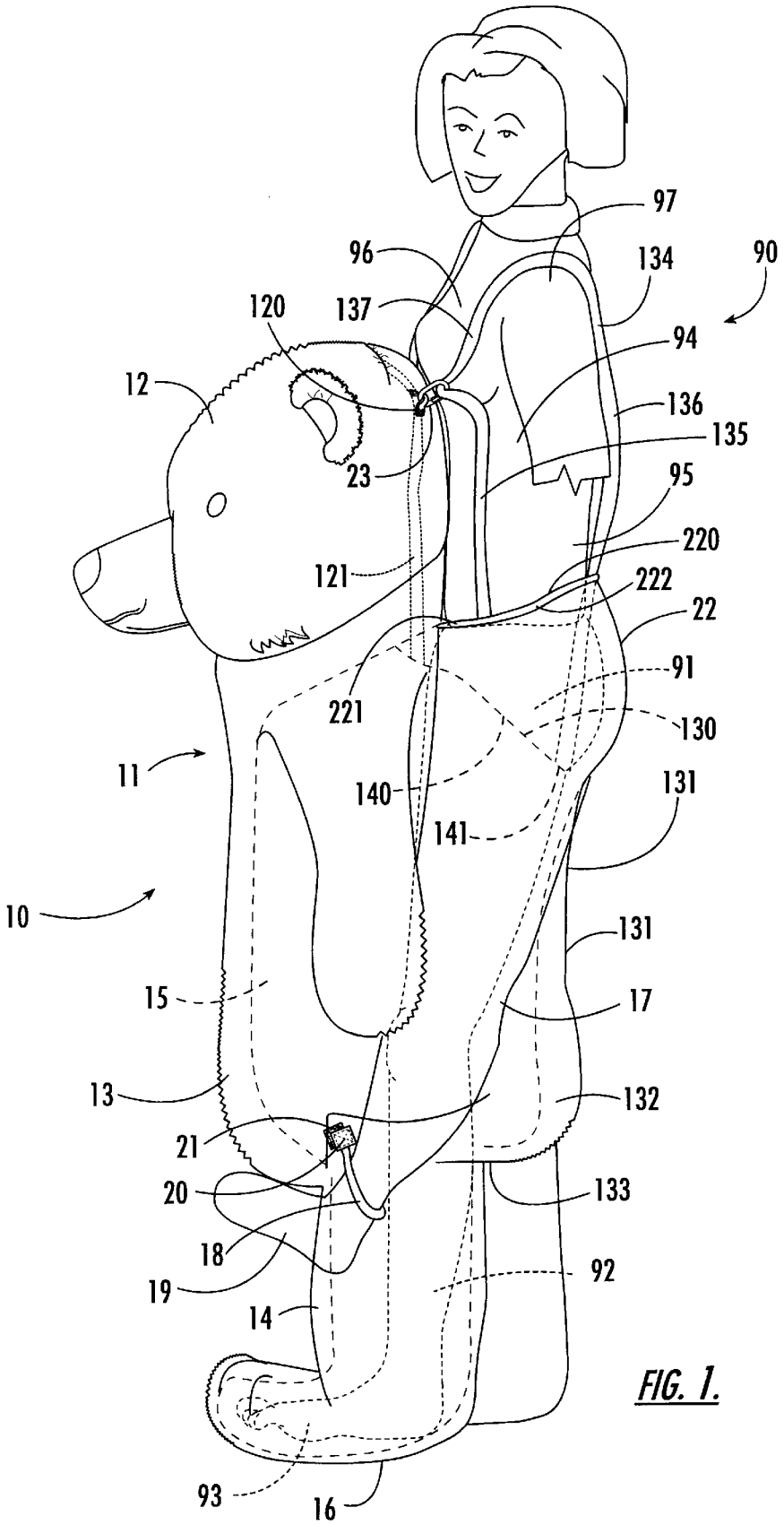
FIG. 1 is a side perspective view of the invention being worn as a costume.
Figure 2:
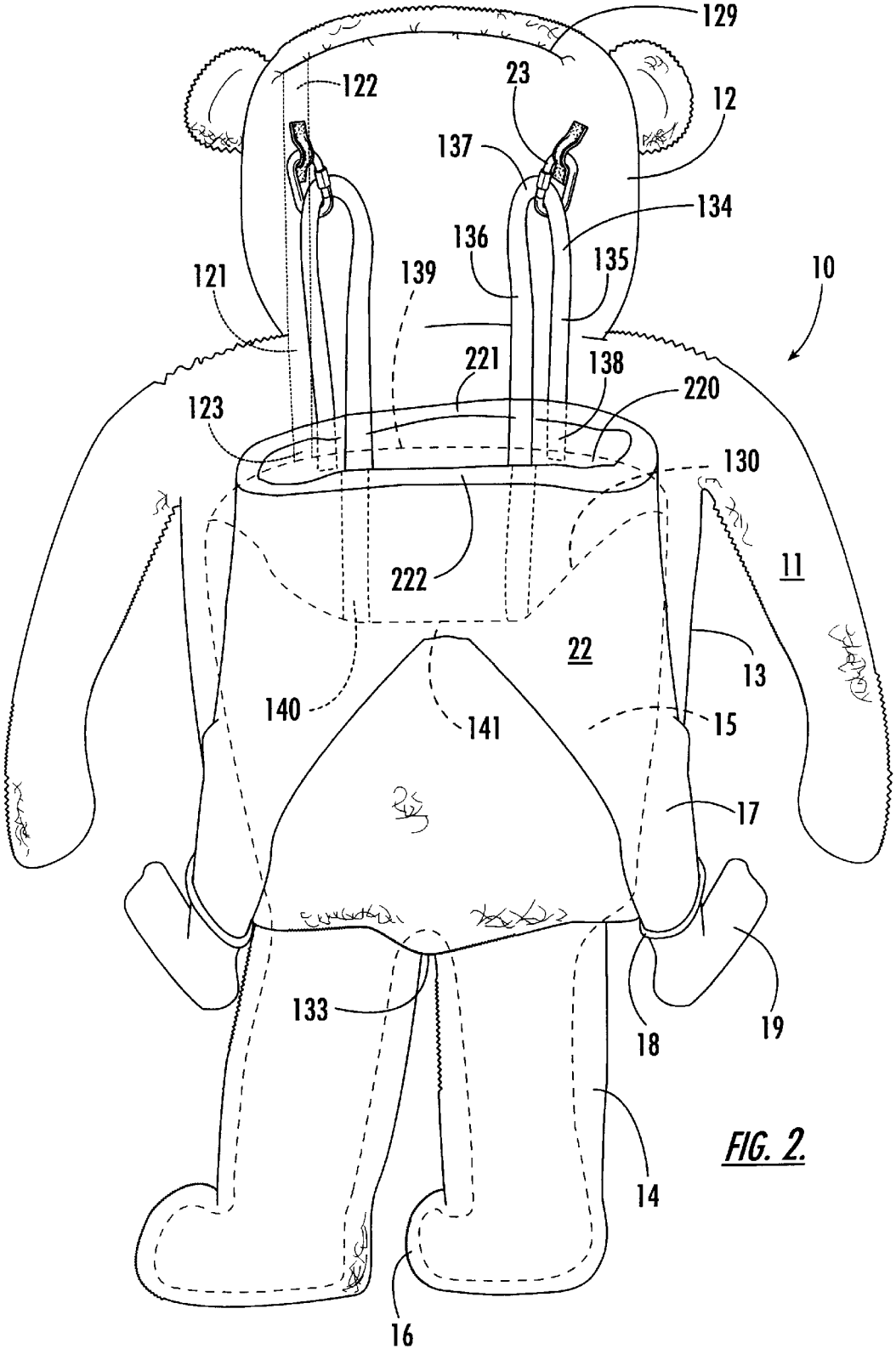
FIG. 2 is a rear view of the costume.
Figure 3:
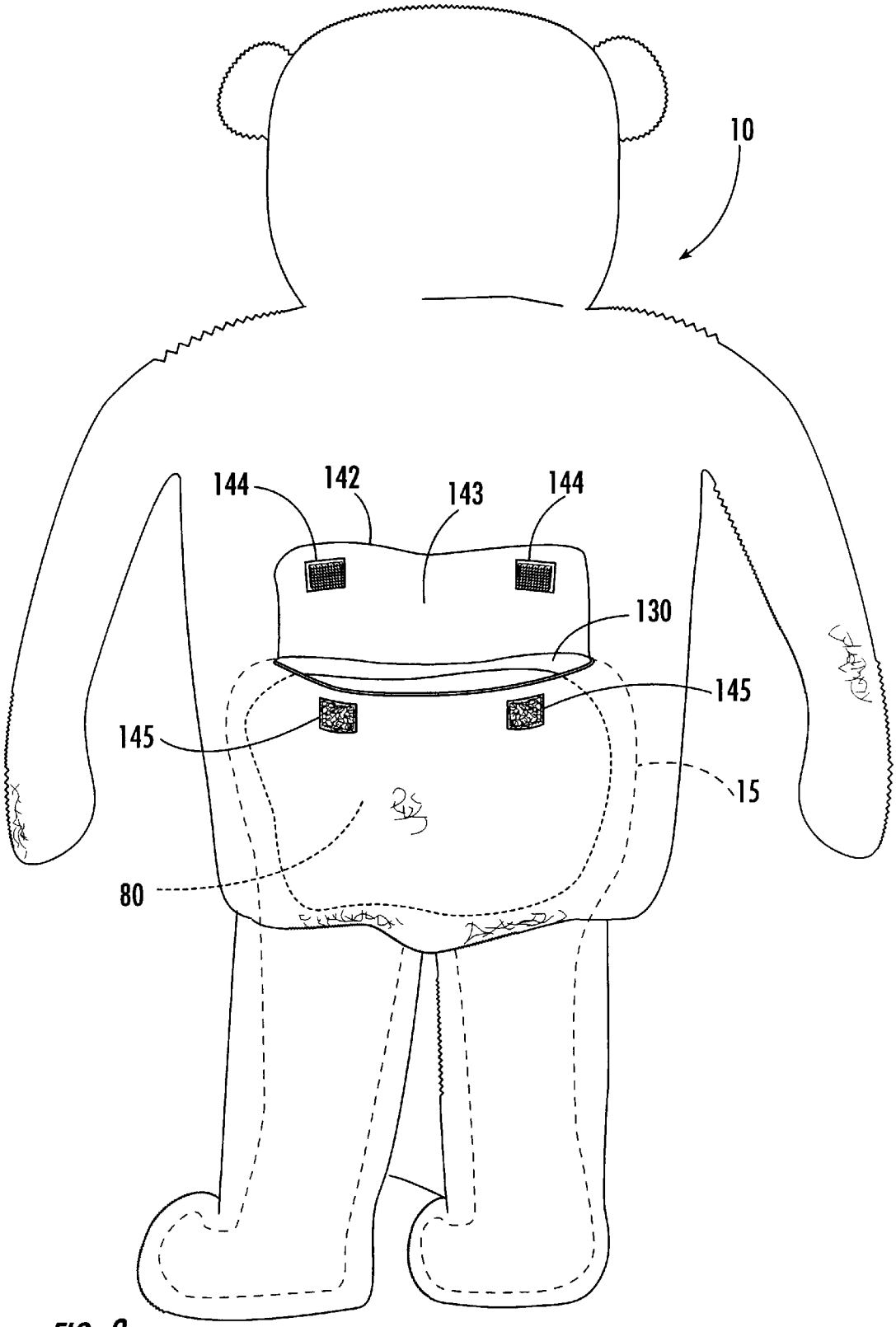
FIG. 3 is a rear view of the invention in the toy configuration.

A description of the preferred embodiments of the present invention will now be presented with reference to FIGS. 1–3.

The costume 10 as illustrated in FIGS. 1 and 2 comprises a character, here shown as a bear 11. This is not intended as a limitation, however, as any creature with at least two limbs or appendages and a head or upper portion could be represented. Also in this embodiment the costume 10 comprises a plush-type surface, although this is not intended as a limitation, and other fabrics can also be used.

Here the bear 11 has a head 12, a body section 13, and at least two legs 14. The body section 13 and the legs 14 have a common interior space 15. The body section 13 has an opening 130 thereinto from its back portion 131. The interior space 15 and the opening 130 are adapted to admit a lower body section 91 and legs 92 of a wearer 90 thereinto. As shown in FIG. 1, the wearer's legs 92 are inserted into the costume's legs 14, with the wearer's feet 93 covered, at least partially, by the costume's feet 16.

It should be noted that the "head" 12, "body section" 13, and "legs" 14 referred to herein are not to be taken as a limitation. Any costume character having limbs or appendages could be equally represented, whether it be an animal, an insect, bird, reptile, or any other character, real or fantastic.

The body section 13 also comprises a lower portion 132 that has a bottom edge 133. The two legs 14 are affixed to the body section 13 above and in spaced relation from the bottom edge 133, so that the lower portion 132 reaches beneath the wearer's torso 94. Preferably the bottom edge 133 is elasticized for being retained beneath the wearer's torso 94.

A pair of false legs 17 are affixed to a rear of the body section 13 in such a way that they depend generally downward and forward toward the front of the costume 10. The legs 17 are positioned to provide an illusion that in use the wearer 90 is being carried by the bear 11.

In a particular embodiment, the costume 10 further comprises means for retaining the false legs 17 in a midsection-encircling orientation relative to the body section 13. Such means may comprise, for example, a pair of elastic loops 18 affixed to the body section 13 along each side thereof. Each loop 18 is adapted to permit a leg end, here shown as a foot 19, to be inserted thereinto and retained thereby. Also preferably the elastic loops 18 are removably affixed to the body section 13, such as with cooperating Velcro® (hook-and-loop-type) strips 20,21, although this is not intended as a limitation.

In order to further the illusion of the wearer's 90 being carried by the bear 11, the false legs 17 comprise a garment, which may comprise, for example, a pair of trousers, here bib-type overalls 22, having false feet 19. Alternatively, the false legs 17 could be at least partially covered with a skirt. Such a garment may take any form known in the art for covering and for providing the illusion of covering, at least the lower body portion of the wearer, and this embodiment is not intended as a limitation. The overalls 22 have a waist 220 opening in communication with the interior space 15 that is adapted to encircle a waist 95 of the wearer 90.

The garment 22, legs 14, feet 16, and interior space 15 preferably comprise a lining (not illustrated) having an upper edge at the waist 220 and adapted to provide a continuous portal through which the wearer 90 inserts his/her feet 93, legs 92, and lower torso 91.

The costume 10 also comprises means for supporting the bear's head 12 in an upright orientation against the wearer's chest 96. The support means here comprises a pair of suspender straps 134. Each strap 134 is affixable along a front section 135 adjacent the waist opening 220 along a front portion 221 thereof. Each strap 134 is also affixable along a back section 136 adjacent the waist opening 220 along a back portion 222 thereof. Further, each strap 134 is affixable along a central portion 137 to the bear's head 12. The suspender straps 134 are adapted to reach over the shoulders 97 of the wearer 90.

Preferably the front section 135 of each strap 134 further extends generally downward from the waist opening 220 inside the trousers 22, and is affixed at a front end 138 along a front portion 139 of the body section opening 130, and wherein the back section 136 of each strap 134 further extends generally downward from the waist opening 220 and is affixed at a back end 140 along a back portion 141 of the body section opening 130.

As shown in FIG. 1, each strap 134 comprises a clip 23 affixed along the strap's central portion 137 and wherein the bear's head 12 comprises a pair of eyelets 120 adapted to removably engage one of the clips 23. The support means further comprises a pair of interior straps 121 (only one shown in FIG. 2), each of which is affixed at a top end 122 to a seam 129 across the bear's head 12. In spaced relation from the top end 122, along a central portion, the strap 121 protrudes through the head material to be affixed to the eyelet 120 and extends inside the head 12 to a bottom end 123. The interior straps 121 are affixed adjacent the body section opening 130 along the front portion 139. These interior straps 121 serve to relieve stress on the character fabric.

Another of the advantageous features of the present invention 10 is its interconvertability between the costume configuration and a toy configuration. As shown in FIG. 3, the interior space 15 and the opening 130 are adapted to admit the false legs 17, trousers 22, and straps 134 when disengaged from the head 12, shown in FIG. 3 as a mass 80 bundled into the space 15.

Preferably the body section 13 also has means for reversibly closing the opening 130 following insertion of the false legs 17, trousers 22, and straps 134. In the embodiment shown in FIG. 3, the body section 13 comprises a flap 142 positioned above the opening 130 and dimensioned to cover the opening 130 in the toy configuration. Further, the flap 142 has an underside 143 to which are affixed a first patch 144 comprising a first side of a closure means such as a hook-and-loop-type fastener. A second patch 145 comprising a second side of a closure means such as a hook-and-loop-type fastener is affixed beneath the opening 130 on the exterior surface of the body section 13. The second patch 145 is positioned to engage the first patch 144 when in the toy configuration. In the embodiment illustrated in FIG. 3, two sets of patches 144,145 are shown.

It may be appreciated by one skilled in the art that additional embodiments may be contemplated, including, as mentioned, different characters being represented.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A costume comprising a character having:

a headlike section, a body section extending beneath the headlike section, and at least two limbs extending beneath the body section, wherein the body section and the limbs have a common interior space and the body section has an opening thereinto from a back portion, the interior space and the opening adapted to admit a lower body section and legs of a wearer thereinto, a pair of human-appearing false legs affixed to a rear of the costume, depending downward and forward toward a front of the costume, and positioned to provide an illusion that in use the wearer is being carried on a back of the costume character;

means for supporting the headlike section in an upright orientation against a chest of the wearer; and means for being retained on the wearer.

2. The costume recited in claim 1, further comprising a garment affixed to the rear of the costume in at least partially covering relation to the false legs, and wherein the false legs comprise a pair of false feet protruding from a bottom end thereof.

3. The costume recited in claim 2, wherein the garment has a waist opening in communication with the interior space adapted to encircle a body of the wearer generally adjacent a waist region.

4. The costume recited in claim 3, wherein the support means comprises strap means affixable along a front section to the character headlike section and along a back section adjacent the waist opening along a back portion thereof.

5. The costume recited in claim 3, wherein the support means and the means for being retained comprises a pair of suspender straps, each strap affixable along a front section adjacent the waist opening along a front portion thereof, along a back section adjacent the waist opening along a back portion thereof, and along a central portion to the character headlike section, the suspender straps adapted to reach over the shoulders of the wearer.

6. The costume recited in claim 5, wherein each strap comprises a clip means affixed along the central portion and wherein the character headlike section comprises a pair of eyelets adapted to removably engage one of the clip means.

7. The costume recited in claim 6, wherein the support means further comprises a pair of interior straps, each interior strap affixed along a central portion to one of the clip means and a bottom end affixed along the waist opening front portion and running inside the headlike section.

8. The costume recited in claim 5, wherein the front section of each strap further extends generally downward from the waist opening and is affixed at a front end along a front portion of the body section opening, and wherein the back section of each strap further extends generally downward from the waist opening and is affixed at a back end along a back portion of the body section opening.

9. The costume recited in claim 5, wherein the garment is selected from a group consisting of a pair of bib-type overalls and a skirt.

10. The costume recited in claim 1, wherein the body section comprises means for retaining the false legs in a midsection-encircling orientation relative to the body section.

11. The costume recited in claim 10, wherein the leg-retaining means comprises a pair of elastic loops affixed to the body section along each side thereof, each loop adapted to permit a leg end to be inserted thereinto and retained thereby.

12. The costume recited in claim 11, wherein the elastic loops are removably affixed to the body section.

13. The costume recited in claim 1, wherein the body section comprises a lower portion having a bottom edge and wherein the two limbs are affixed to the body section in spaced relation from the bottom edge, the lower portion dimensioned to reach beneath a torso of the wearer.

14. The costume recited in claim 13, wherein the bottom edge is elasticized for being retained beneath the wearer's torso.

15. A combination object adaptable between a costume configuration and a toy configuration comprising a character having:

a headlike section, a body section extending beneath the headlike section, and at least two limbs extending beneath the body section;

a pair of human-appearing false legs affixed to a rear of the object and, when the object in the costume configuration, depending downward and forward toward a front of the object and positioned to provide an illusion that in use the wearer is being carried on a back of the character;

means for supporting the headlike section in an upright orientation against a chest of the wearer when the object is in the costume configuration; and means for being retained on the wearer;

wherein the body section and the limbs have a common interior space and the body section has an opening thereinto from a back portion, the interior space and the opening adapted to admit a lower body section and legs of a wearer thereinto for use in the costume configuration, the interior space and the opening further adapted to admit the false legs and the means for being retained thereinto for use in the toy configuration.

16. The object recited in claim 15, further comprising a garment affixed to a rear of the object in at least partially covering relation to the false legs, and wherein the false legs comprise a pair of false feet protruding from a bottom end thereof.

17. The object recited in claim 16, wherein the garment has a waist opening in communication with the body section opening, the waist opening adapted to encircle the wearer generally adjacent a waist region for use in the costume configuration.

18. The object recited in claim 15, wherein the support means and the means for being retained comprise strap means affixable along a front section to the character headlike section and along a back section adjacent the waist opening along a back portion thereof.

19. The object recited in claim 15, wherein the support means and the means for being retained comprise a pair of suspender straps, each strap affixable along a front section adjacent the waist opening along a front portion thereof, along a back section adjacent the waist opening along a back portion thereof, and along a central portion to the character headlike section, the suspender straps adapted to reach over the shoulders of the wearer.

20. The object recited in claim 15, further comprising means for reversibly closing the body section opening for retaining the legs and the means for being retained within the interior space in the toy configuration.

21. A method of making a costume, comprising the steps of:

making a character part having a headlike section, a body section extending beneath the headlike section, and at least two limbs extending beneath the body section, wherein the body section and the limbs have a common interior space and the body section has an opening thereinto from a back portion, the interior space and the opening adapted to admit a lower body section and legs of a wearer thereinto;

affixing a pair of human-appearing false legs to a rear of the costume, the legs depending downward and forward toward a front of the costume and positioned to provide an illusion that in use the wearer is being carried on a back of the costume character;

providing means for supporting the headlike section in an upright orientation when in use in a position against a chest of the wearer; and providing means for being retained on the wearer.

22. A method of interconverting an object between a costume configuration and a toy configuration, the object comprising a character having:

a headlike section, a body section extending beneath the headlike section, and at least two limbs extending beneath the body section;

a pair of human-appearing false legs affixed to a rear of the object and, when the object in the costume configuration, depending downward and forward toward a front of the object and positioned to provide an illusion that in use the wearer is being carried on a back of the character;

means for supporting the headlike section in an upright orientation against a chest of the wearer when the object is in the costume configuration; and means for being retained on the wearer when in the costume configuration;

the body section and the limbs having a common interior space and the body section having an opening thereinto from a back portion, the interior space and the opening adapted to admit a lower body section and legs of a wearer thereinto for use in the costume configuration;

the method comprising the steps of:

placing the false legs and the means for being retained within the interior space through the opening; and reversibly closing the opening to retain the false legs and the means for being retained within the interior space for use in the toy configuration.

* * * * *